US010273627B2

(12) United States Patent
Yoon et al.

(10) Patent No.: US 10,273,627 B2
(45) Date of Patent: Apr. 30, 2019

(54) CLOTHES TREATING APPARATUS

(71) Applicant: LG ELECTRONICS INC., Seoul (KR)

(72) Inventors: Juhan Yoon, Seoul (KR); Seongwoo An, Seoul (KR); Sangho Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 239 days.

(21) Appl. No.: 15/392,098

(22) Filed: Dec. 28, 2016

(65) Prior Publication Data

US 2017/0191212 A1 Jul. 6, 2017

(30) Foreign Application Priority Data

Jan. 5, 2016 (KR) ..... 10-2016-0001189

(51) Int. Cl.

| | |
|---|---|
| ***D06F 25/00*** | (2006.01) |
| ***D06F 37/04*** | (2006.01) |
| ***D06F 39/04*** | (2006.01) |
| ***D06F 58/20*** | (2006.01) |
| ***D06F 58/22*** | (2006.01) |

(Continued)

(52) U.S. Cl.

CPC ..... *D06F 58/206* (2013.01); *D06F 25/00* (2013.01); *D06F 37/04* (2013.01); *D06F 39/04* (2013.01); *D06F 58/22* (2013.01); *D06F 58/24* (2013.01); *D06F 58/26* (2013.01)

(58) Field of Classification Search

CPC ..... D06F 58/206; D06F 25/00; D06F 37/04; D06F 39/04; D06F 58/22; D06F 58/24; D06F 58/26

USPC ..... 34/73

See application file for complete search history.

(56) References Cited

U.S. PATENT DOCUMENTS 4,122,611 A * 10/1978 Marchal ..... D21F 5/20 34/242

4,621,438 A * 11/1986 Lanciaux ..... D06F 58/04 34/242

(Continued)

FOREIGN PATENT DOCUMENTS

| | | |
|---|---|---|
| CN | 104011285 | 8/2014 |
| CN | 104603350 | 5/2015 |

(Continued)

OTHER PUBLICATIONS

International Search Report and Written Opinion dated Feb. 17, 2017 issued in Application No. PCT/KR2016/012801.

(Continued)

*Primary Examiner* — Stephen M Gravini

(74) *Attorney, Agent, or Firm* — Ked & Associates, LLP

(57) ABSTRACT

A clothes treating apparatus may includes a cabinet, a drum provided within the cabinet and having an accommodation space for laundry for washing or drying, an evaporator to allow a refrigerant to undergo heat exchange with air discharged from the drum to dehumidify air, and a foreign object cleaning unit that injects water on the evaporator to clean foreign objects stuck to the evaporator. The foreign object cleaning unit may is configured to inject washing water supplied from a washing water supply unit to a surface of the evaporator at a prescribed angle.

21 Claims, 9 Drawing Sheets

(51) Int. Cl.
*D06F 58/24* (2006.01)
*D06F 58/26* (2006.01)

(56) References Cited

U.S. PATENT DOCUMENTS 8,024,948 B2 * 9/2011 Kitamura ..... D06F 58/22 68/18 F
8,104,191 B2 * 1/2012 Ricklefs ..... D06F 58/203 34/474
8,240,064 B2 * 8/2012 Steffens ..... D06F 58/22 34/210
8,245,347 B2 * 8/2012 Goldberg ..... D06F 58/24 34/210
8,382,887 B1 * 2/2013 Alsaffar ..... B01D 46/0058 55/289
8,615,895 B2 * 12/2013 Shin ..... D06F 58/22 34/606
8,789,287 B2 * 7/2014 Kim ..... D06F 58/22 34/480
8,789,290 B2 * 7/2014 Grunert ..... D06F 58/24 34/469
8,984,767 B2 * 3/2015 Grunert ..... D06F 58/22 34/138
9,027,256 B2 * 5/2015 Kim ..... F26B 21/003 34/86
9,134,067 B2 * 9/2015 Ahn ..... D06F 58/206
9,249,538 B2 * 2/2016 Bison ..... D06F 58/24
2005/0044744 A1 * 3/2005 Tadano ..... D06F 58/206 34/596
2006/0048404 A1 * 3/2006 Tadano ..... D06F 58/206 34/134
2008/0235977 A1 * 10/2008 Kuwabara ..... D06F 58/206 34/77
2009/0031513 A1 * 2/2009 Goldberg ..... D06F 58/20 15/88.4
2017/0191212 A1 * 7/2017 Yoon ..... D06F 58/206

FOREIGN PATENT DOCUMENTS

DE 10 2006 061 211 6/2008
EP 2 628 846 8/2013
EP 2 669 417 12/2013
EP 2 708 639 3/2014
EP 3249094 A1 * 11/2017 ..... D06F 58/02
EP 3190225 B1 * 6/2018 ..... D06F 58/206
JP 2012-095718 5/2012
JP 2013-052067 3/2013
KR 10-2014-0050984 4/2014
KR 10-2014-0065265 5/2014
KR 10-2014-0147026 12/2014
WO WO 2014/038112 3/2014
WO WO 2017039298 A1 * 3/2017 ..... B08B 3/02
WO WO 2017119586 A1 * 7/2017 ..... D06F 58/206

OTHER PUBLICATIONS

European Search Report dated Mar. 9, 2017 issued in Application No. 16204926.6.
Chinese Office Action dated Aug. 15, 2018 issued in Application No. 201611186367.2 (with English translation).

* cited by examiner

CLOTHES TREATING APPARATUS

CROSS-REFERENCE TO RELATED APPLICATION(S)

Pursuant to 35 U.S.C. § 119(a), this application claims the benefit of earlier filing date and right of priority to Korean Application No. 10-2016-0001189, filed on Jan. 5, 2016, the contents of which is incorporated by reference herein in its entirety.

BACKGROUND

1. Field

Provided is a clothes treating apparatus in which hot air is supplied to inside of a drum using a heat pump.

2. Background

Clothes treating apparatuses having hot air supply using heat pumps are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1A:
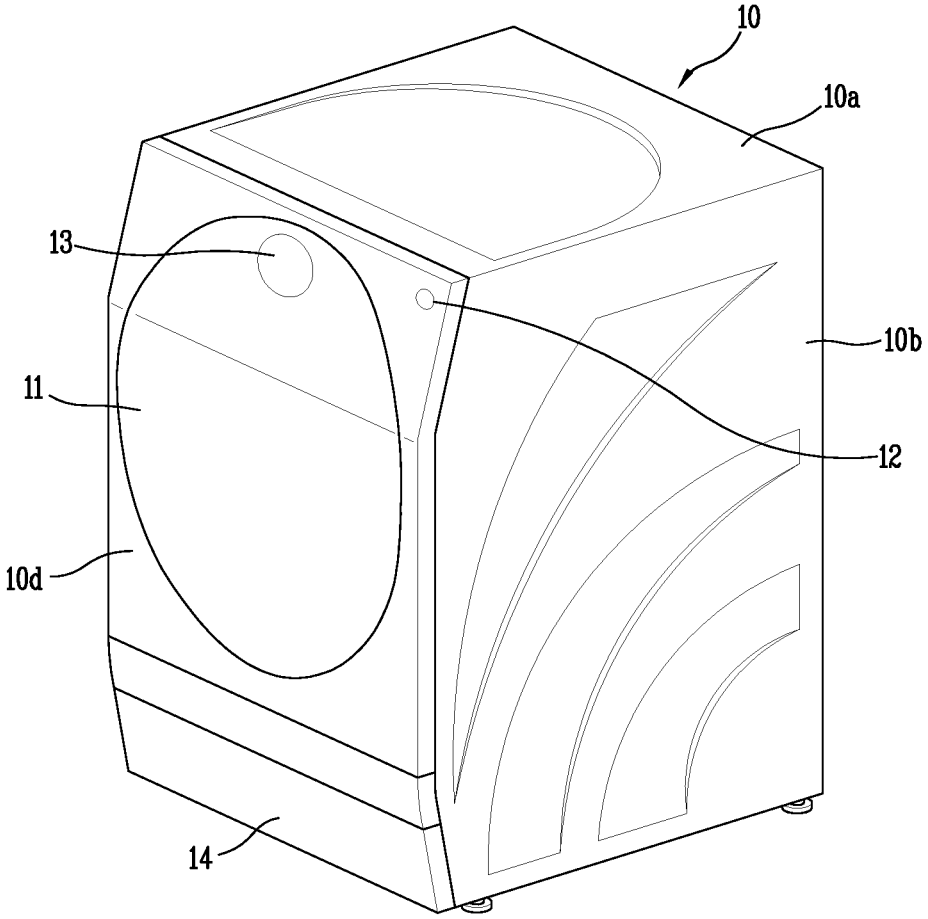
FIG. 1A is a perspective view illustrating an appearance of a clothes treating apparatus according to the present disclosure.

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a clothes treating apparatus having a heat pump module related to the present disclosure will be described with reference to the accompanying drawings, in which like numbers refer to like elements throughout although the embodiments are different. As used herein, the singular forms "a", "an" and "the" are intended to include the plural forms as well, unless the context clearly indicates otherwise.

A clothes treating apparatus may include a washing machine for washing clothes, a dryer for drying clothes, or the like, or a washing dryer for washing and drying clothes, or the like. A clothes treating apparatus having a dry function may include a drum, to which clothes to be washed and dried, or the like, are placed, within a cabinet, and may be classified as a circulation type and an exhaust type according to a method of processing air of high temperature and humidity released after evaporating moisture of laundry within the drum.

In the case of the circulation type, air of high temperature and humidity discharged from the inside of the drum may undergo heat exchange with a heat exchanger and re-supplied to the drum, rather than being discharged to outside of the cabinet, so as to be circulated, and moisture in the air is condensed by the heat exchanger. In the case of the exhaust type, air of high temperature and humidity discharged from the inside of the drum is directly discharged to outside of the cabinet so as to be discarded.

Air released from the drum after being used to dry the laundry introduced to the drum may include foreign objects such as lint separated from the laundry. When such foreign object passes through a mechanical component of the clothes treating apparatus, it may cause the mechanical component to prematurely break down, or when the foreign object is discharged to the outside, it may contaminate ambient air.

Thus, air discharged from the drum is controlled to pass through a filter such that a foreign object may be filtered out by the filter. However, fine lint or a foreign object may pass through the filter and may be collected in an air inlet of a heat exchanger. When a predetermined amount of foreign objects such as fine lint, or the like, is accumulated in the heat exchanger, flow resistance of air is generated due to the foreign objects accumulated when air passes through the heat exchanger, reducing an air volume and flow to degrade dry performance.

In one case, a user may open a cover and directly removes the lint accumulated in the heat exchanger using a cleaning tool. This method, however, is cumbersome because the cover may require to be separated or uninstalled and may create unwanted dust.

In another method for removing lint accumulated in the heat exchanger, a clothes treating apparatus may include a cleaning unit. Such a clothes treating apparatus may be operated by an external force and physically removes a foreign object such as lint, or the like, using the cleaning unit for removing the lint adhered to the heat exchanger. With the cleaning unit, the user may manually move a brush through an operation unit exposed to the outside of the cabinet or an external force based on a mechanical force may be applied to the brush of a lint removing unit, to scrape a front surface of the heat exchanger to physically remove the foreign object such as the lint, or the like. However, in this case, a manual operation force or an external force based on a mechanical force should be provided to the externally exposed operation unit.

A clothes treating apparatus and a foreign object cleaning unit that addresses these and other disadvantages are disclosed hereinafter with reference to the accompanying drawings.

FIG. 1A is a perspective view illustrating an appearance of a clothes treating apparatus according to the present disclosure. A cabinet 10 may have a hexahedral shape. The cabinet 10 includes a top cover 10*a* forming an upper surface of the hexahedron, side covers 10*b* forming both side surfaces of the hexahedron, a front cover 10*d* forming a front surface of the hexahedron, a back cover 10*e* forming a rear surface of the hexahedron, and a base cover 10*c* forming a lower surface of the hexahedron.

The front cover 10*d* may include an opening for introducing a laundry or a dry target such as clothes, or the like, inside the cabinet 10. Also, a circular door 11 for opening and closing the opening may be provided on the front cover 10*d*. A left side of the door 11 may be coupled by a hinge and a right side thereof may be rotatable in a forward/backward direction. A pressing type locking device may be provided on the right side of the door 11. Thus, when a right end portion of the door 11 is pressed once, the door 11 is locked and when it is pressed again, the door 11 is unlocked.

Also, a power button 12 may be provided at a right upper end of the front cover 10*d* to turn on and off power of the clothes treating apparatus. A display unit 13 may be formed at an upper end portion of the door 11. The display 13 may display a current operation, a mode, and the like, of the clothes treating apparatus. A touch type control panel is provided on the display unit 13 and various functions may be selected to perform washing and dry functions or released.

A detergent supply unit may be installed between a lower portion of a tub 17 and a lower surface of the cabinet 10 such that it is drawn out and inserted in a drawer manner. A lower cover 14 may be coupled to a lower end portion of the front cover 10*d* by a lower hinge so as to be rotatable in a vertical direction.

Figure 1B:
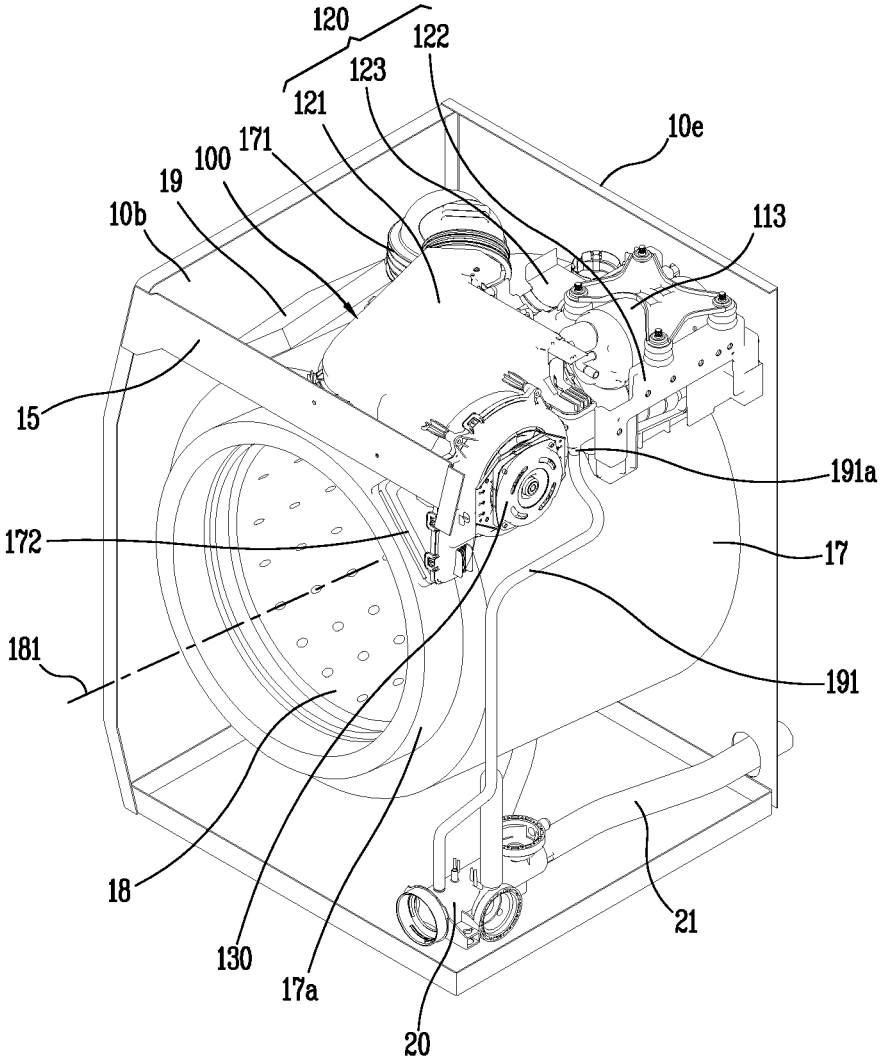
FIG. 1B is a perspective view illustrating a configuration in which a heat pump module is disposed within a cabinet.

FIG. 1B is a perspective view illustrating a configuration in which a heat pump module is disposed within the cabinet. A cylindrical tub 17 may be provided within the cabinet 10. An opening communicating with the opening of the front cover 10*d* may be formed on a front side of the tub 17 to allow laundry and a dry target to be taken in and out. A hollow part may be provided within the tub 17 to store washing water. A gasket 17*a* may extend from the opening of the tub 17 to the opening of the front cover 10*d* in a circumferential direction to prevent leakage of washing water kept in the tub 17 to outside and prevent transmission of vibration generated in the tub 17 to the cabinet 10 when the drum 18 is rotated. The gasket 17*a* may be formed of a vibration insulating member such as rubber. An air outlet 171 may be formed on upper rear side of the tub 17 to allow air to be discharged from the tub 17. An air inlet 172 may be formed in an upper portion of the gasket 17*a* of the tub 17 to allow air to be introduced to the tub 17.

A cylindrical drum 18 may be rotatably provided within the tub 17. The drum 18 has an accommodation space for accommodating laundry and a dry target therein, and has an opening formed on a front side of the drum 18 and communicating with the opening of the tub 17. The drum 18 may have a plurality of through holes formed on an outer circumferential surface thereof to allow washing water and air to pass through the through holes between the drum 18 and the tub 17. A lifter may be installed at an interval in a circumferential direction within the drum 18, to tumble laundry introduced to the inside of the drum 18. For example, in a washing cycle, washing water supplied to the tub 17 is introduced to the inside of the drum 18 through the through holes, and when the drum 18 is rotated, the laundry introduced to the inside of the drum 18 is wet to be washed. Also, in a drying cycle, hot air supplied to the inside of the tub 17 is introduced to the inside of the drum 18 through the through holes, and as the drum 18 rotates, moisture of laundry introduced to the inside of the drum 18 is evaporated by hot air to dry the laundry.

The heat pump module 100 integrally modularizes an evaporator 111, a compressor 113, a condenser 112, and an expansion valve 114 forming a heat pump cycle by the integral housing 120. A circulation fan 130 and the vapor-liquid separator 115 may also be integrally installed by the integral housing 120. The modularized heat pump module 100 may be disposed between an upper portion of the tub 17 and a top cover 10*a*.

The integral housing 120 may include a heat exchange duct unit 121 accommodating the evaporator 111 and the condenser 112 and a compressor base part 122 supporting the compressor 113. The heat exchange duct unit 121 may be disposed on a front side in an upper portion of the tub 17, and accommodates and supports the evaporator 111 and the condenser 112 therein, and is connected to the tub 17 to serve as a circulation duct forming a circulation flow channel for circulating air. Moreover the compressor base part 122 may serve to support the compressor 113 hung in a space between an upper portion of the tub 17 and a side corner of the cabinet 10.

The integral housing 120 may be supported in a forward/backward direction by a front side of the cabinet 10, for example, a front frame 15, and a rear side of the cabinet 10, for example, an upper portion of the back cover 10*e*. A front side of the heat exchange duct unit 121 may be in contact with a rear surface of the front frame 15 and fastened by a fastening member such as a screw, or the like. A rear side of the compressor base part 122 may be in contact with a front side of the back cover 10*e* and fastened by a fastening member such as a screw.

The integral housing 120 may be disposed to be spaced apart from an upper outer circumferential surface of the tub 17 to prevent transmission of vibrations generated by the drum 18 when the drum 18 rotates, to the heat pump module 100 through the tub 17. Also, transmission of vibrations generated by the compressor 113 to the tub 17 through the compressor base part 122 may be prevented.

Also, since the evaporator 111, the compressor 113, the condenser 112, the expansion valve 114, and the like, forming a heat pump cycle are integrated by the integral housing 120, a disposition space of a heat pump system may be compactly optimized.

The heat pump module 100 intakes air discharged from the drum 18 and heat-exchanges it with the evaporator 111 to absorb heat from the air through the evaporator 111 and removes moistures in the air (dehumidification function of the heat pump module 100). Also, the heat pump module 100 heat-exchanges air discharged from the evaporator 111 with the condenser 112 to discharge heat from a refrigerant passing through the condenser 112 as air to be re-supplied to the inside of the tub through the condenser 112 (heat source supply function of the heat pump module 100).

The heat pump module 100 may include a circulation fan 130 to pull in air discharged from the drum 18. The circulation fan 130 may be integrally installed on the right side of the heat exchange duct unit 121.

A drain hose 19 may be provided at a lower end portion of the right side of the heat pump module 100. The heat exchange duct unit 121 of the integral housing 120 may be positioned in a space between an upper central portion and a right side corner of the cabinet 10, and a lower surface of the heat exchange duct unit 121 may be positioned to be lowered toward the right side. Also, in order to drain condensate generated in the evaporator 111 within the heat exchange duct unit 121 outwardly, a drainage is formed at a lower end of a right side of the heat exchange duct unit 121. One end portion of the drain hose 19 is connected to the drainage and a lower end portion of the drain hose 19 is connected to a drain pump. The drain hose 19 may be positioned to be adjacent to the circulation fan 130 on the right side of the integral housing 120.

The drain pump may be disposed below the tub 17. For example, after washing water washes the evaporator 111 and a lint filter, washing-finished dirty water may move to the right side along a lower surface of the heat exchange duct unit 121 and discharged to the outside of the cabinet 10 through the drain hose 19, the drain pump, and the drain hose. As air discharged from the drum 18 passes through the evaporator 111, heat is taken away by the evaporator 111 to form condensate, and the condensate may be discharged to the outside through the drain hose 19.

The integral housing 120 may further include a vapor-liquid separator installation part 123 disposed between the heat exchange duct unit 121 and the compressor base part 122. The vapor-liquid separator 115 may be installed in the vapor-liquid separator installation part 123.

A controller controls a general operation of the clothes treating apparatus, as well as the heat pump module 100. The controller may include a PCB case 19 having a flat rectangular box shape in which a height is smaller than a width and length, a PCB installed in the PCB case 19, and electric/electronic control components installed on the PCB.

Figure 1C:
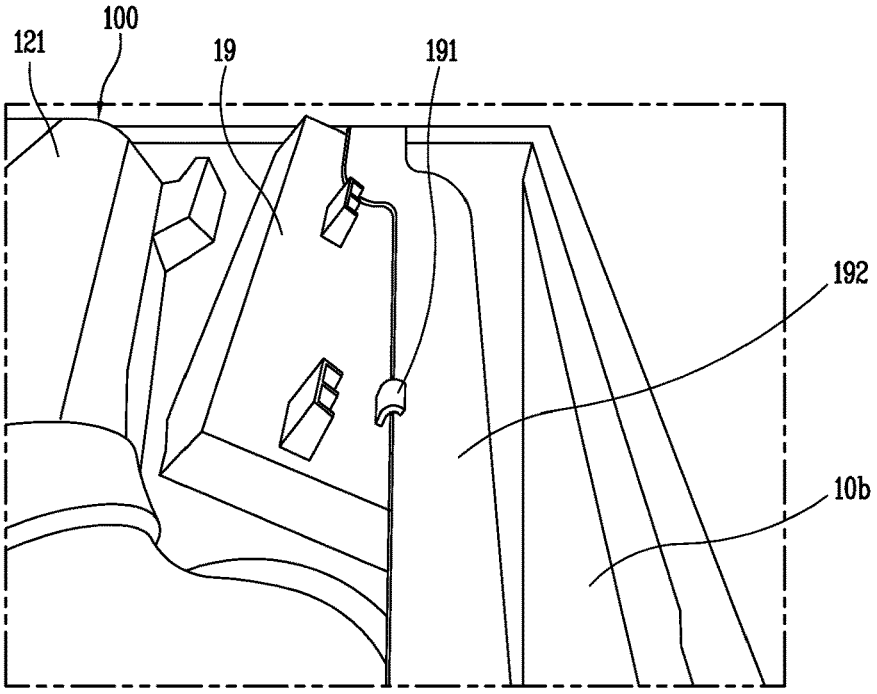
FIG. 1C is a rear perspective view illustrating a fixed structure of a PCB case of FIG. 1B.

FIG. 1C is a rear perspective view illustrating a fixing structure of a PCB case of FIG. 1B. The PCB case 19 may be disposed on a left side of the heat pump module 100 in a diagonal direction (when viewed from the front cover 10*d*) by using a space between the upper side of the tub 17 and the left side corner of the cabinet 10.

As for the PCB case 19, a width of the PCB case 19 may be longer than a space between the center above the tub 17 and the left side cover 10*b*. Thus, in order to avoid interference of the PCB case 19 with other components and compactly configure the PCB case 19 together with the heat pump module 100, the PCB case 19 is preferably disposed in a downward direction of the left side from a central upper portion of the cabinet 10 when viewed from the front cover 10*d*. Here, the left side of the heat pump module 100 is positioned between the central upper portion of the cabinet 10 and the upper side of the tub 17 and a space from the left side corner of the cabinet 10 in a downward direction is larger than a space between the central upper portion of the cabinet 10 and the upper side of the tub 17. Thus, the PCB case 19 may be disposed in a diagonal direction such that a right side thereof is disposed to face the left side of the heat pump module 100 and a left side of the PCB case 19 is disposed to face the left side cover 10*b* of the cabinet 10.

In order to stably support the PCB case 19 within the cabinet 10, the PCB case 19 may have a fixing protrusion 191 protruding from one side of an upper surface of the PCB case 19. An upper end portion of the fixing protrusion 191 may have a hook shape. Also, the cabinet 10 may have a fixing member 192 extending from one side of an upper end portion of the front cover 10*d* to one side of an upper end portion of the back cover 10*e* in order to support the PCB case 19. Since the upper end portion of the fixing protrusion 191 is supported to be caught on the side surface of the fixing member 192, the PCB case 19 may be stably supported between the left side corner of the cabinet 10 and the heat pump module 100 and compactly disposed.

The PCB case 19 is electrically connected to the heat pump module 100, and thus, performance of the heat pump module 100 may be inspected in units of modules before a complete product of the clothes treatment apparatus is assembled. Here, since the PCB case 19 is connected to the heat pump module 100 for performance inspection of the heat pump module 100, the PCB case 19 is preferably positioned to be close to the heat pump module 100.

Thus, since the PCB case 19 is disposed in a diagonal direction to be close on the side surface of the heat pump module 100 and connected to the heat pump module 100, the PCB case 19 may be compactly installed within the cabinet 10 together with the heat pump module 100.

Figure 1D:
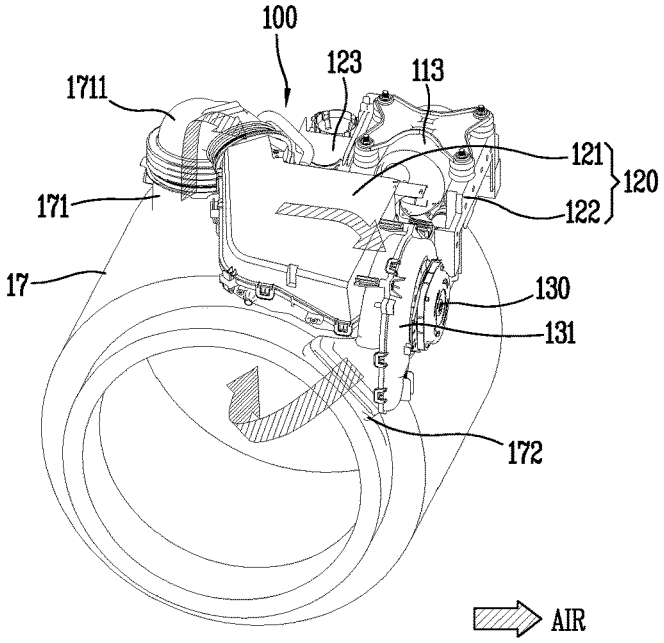
FIG. 1D is a perspective view illustrating a movement path of air in FIG. 1B.

FIG. 1D is a perspective view illustrating a movement path of air through the heat pump module FIG. 1B. A left end portion of the heat exchange duct 121 may be connected to communicate with an air outlet 171 formed on a rear side of an upper portion of the tub 17 through a tub connection duct 1711. A corrugate is formed in a lower portion of the tub connection duct 1711 to prevent transmission of vibrations through the tub 17 to the heat exchange duct unit 121 when the drum 18 is rotated.

A fan duct unit 131 may be provided and connected to a right side of the heat exchange duct unit 121. A circulation fan 130 is accommodated and supported within the fan duct unit 131 and intakes air introduced to the inside of the heat exchange duct unit 121. The fan duct unit 131 connects the heat exchange duct unit 121 and an upper portion of the gasket 17*a* of the tub 17 in a communicating manner.

A circulation flow channel for circulation of air may be formed by the tub connection duct 1711, the heat exchange duct unit 121, and the fan duct unit 131. Air within the drum 18 is released from the rear side of an upper portion of the tub 17 and introduced to the inside of the heat exchange duct unit 121 through the tub connection duct 1711 and passes through the evaporator 111 and the condenser 112 accommodated within the heat exchange duct unit 121, and air discharged from the heat exchange duct unit 121 is drawn in by the circulation fan 130 so as to be re-supplied to the inside of the tub 17 and the drum 18 through the fan duct unit 131.

Figure 2:
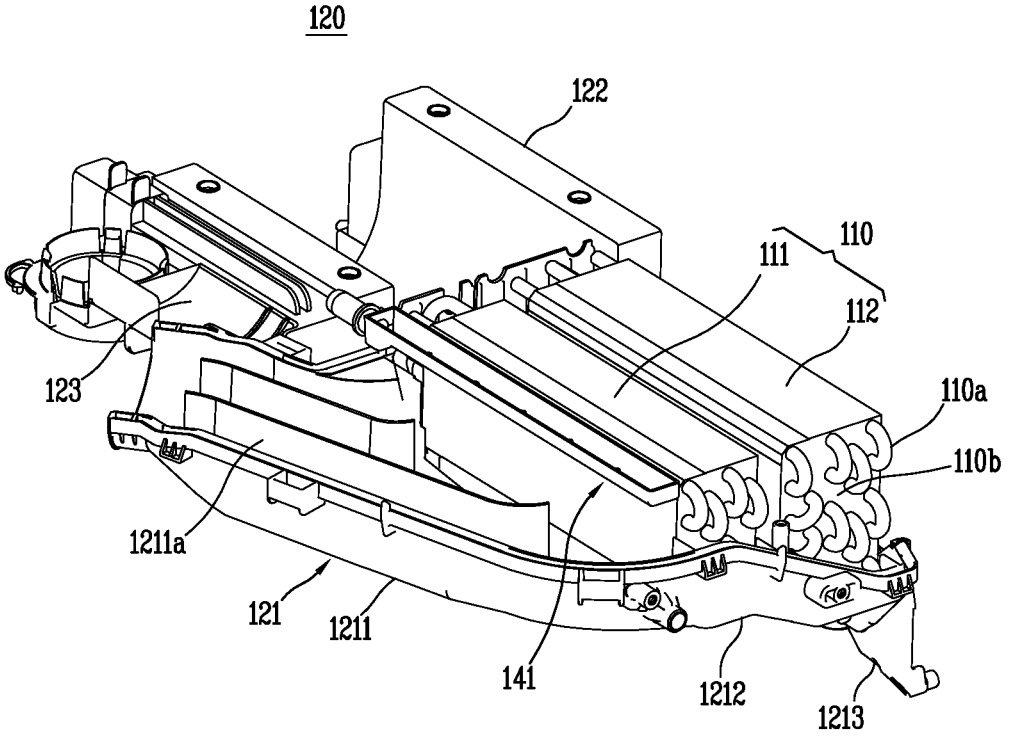
FIG. 2 is a perspective view illustrating an internal structure of a heat exchange duct unit of FIG. 1B.

FIG. 2 is a perspective view illustrating an internal structure of a heat exchange duct unit of FIG. 1B. The heat exchange duct unit 121 may be divided into sections according to functions to include a circulation connection duct 1211 that guides inflow of air, a heat exchange installation part 1212 in which the evaporator 111 and the condenser 112 are installed, and a fan connection duct 1213 that transfers air to the circulation fan 130.

The circulation connection duct 1211 may extend in a diagonal direction from a left side of the heat exchange installation part 1212. An air guide 1211*a* may be provided to vertically protrude from the inside of the circulation connection duct 1211 to smoothly guide movement of air.

The evaporator 111 is installed on the left side, an upstream side, of the heat exchange installation part 1212, and the condenser 112 is installed on the right side, a downstream side, of the heat exchange installation part 1212. Accordingly, air introduced to the heat exchange duct unit 121 sequentially passes through the evaporator 111 and the condenser 112.

Both the evaporator 111 and the condenser 112 may include a plurality of heat transmission plates 110*b* and a refrigerant pipe 110*a*. The heat transmission plate 110*b* is vertically and densely disposed to be spaced apart from each other with a gap therebetween in a direction perpendicular to a movement direction of air in order to expand an area to undergo a heat-exchange with a refrigerant. As air passes through the plurality of heat transmission plates 110*b*, heat is transmitted to the refrigerant pipe through the heat transmission plates 110*b*.

The refrigerant pipe 110*a* forms a refrigerant flow channel allowing a refrigerant to flow therein to undergo heat exchange with air. The refrigerant pipe 110*a* may be a single pipe, and a refrigerant flows within the pipe to undergo heat-exchange with air. The refrigerant pipe 110*a* may penetrate through the heat transmission plate 110*b* and formed to be bent in an S shape in a vertical direction in order to increase a length of a refrigerant flow channel.

Figure 5A:
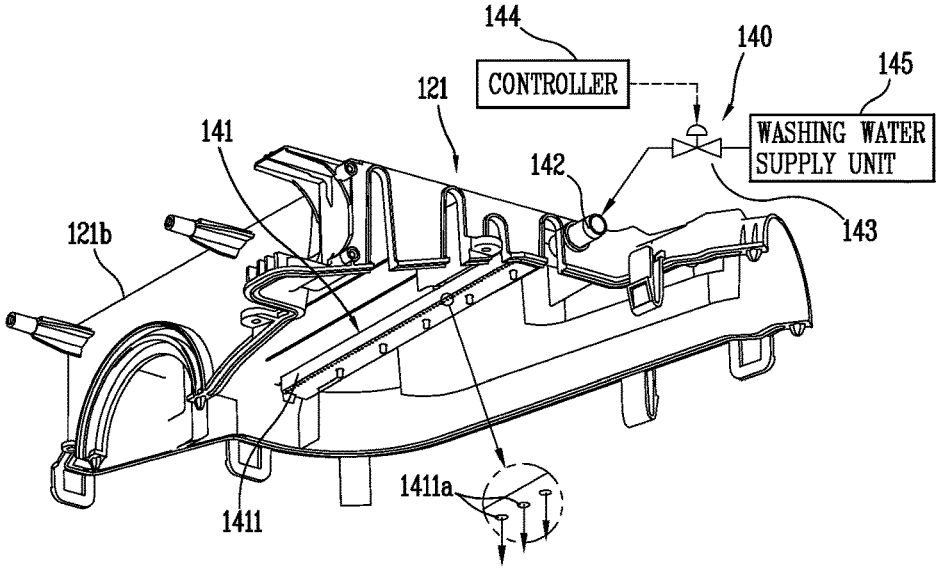
FIG. 5A is a bottom perspective view of a duct cover of FIG. 3B.
Figure 5B:
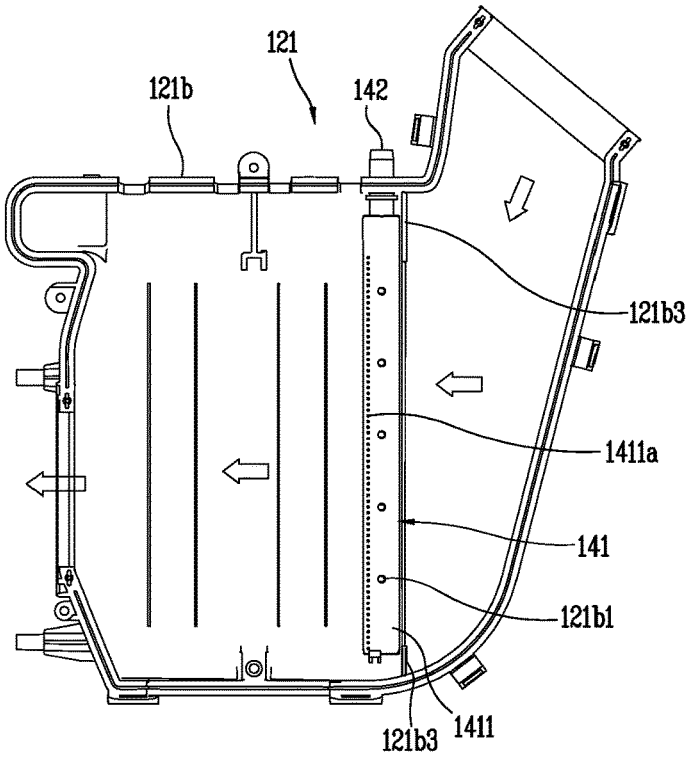
FIG. 5B is a bottom view of a duct cover of FIG. 3B.

A nozzle unit 141 of a foreign object cleaning unit 140 may be provided at an upper end portion of an upstream side of the evaporator 111 to inject washing water toward an air inflow surface of the evaporator 111. Referring to FIGS. 5A and 5B, the foreign object cleaning unit 140 is provided to remove a foreign object such as lint, or the like, accumulated in the air inflow part of the evaporator 111. The foreign object cleaning unit 140 may include the nozzle unit 141 having an injection hole 1411*a* provided on a lower surface thereof and injecting washing water toward the air inflow surface of the evaporator 111 through the injection hole 1411*a*. The nozzle unit 141 may include a nozzle body 1411 having a quadrangular box structure that extends in a direction perpendicular to an air movement direction. A washing water supply pipe 142 may be formed on one side of the nozzle body 1411 to supply washing water to the inside of the nozzle body 1411.

Figure 3A:
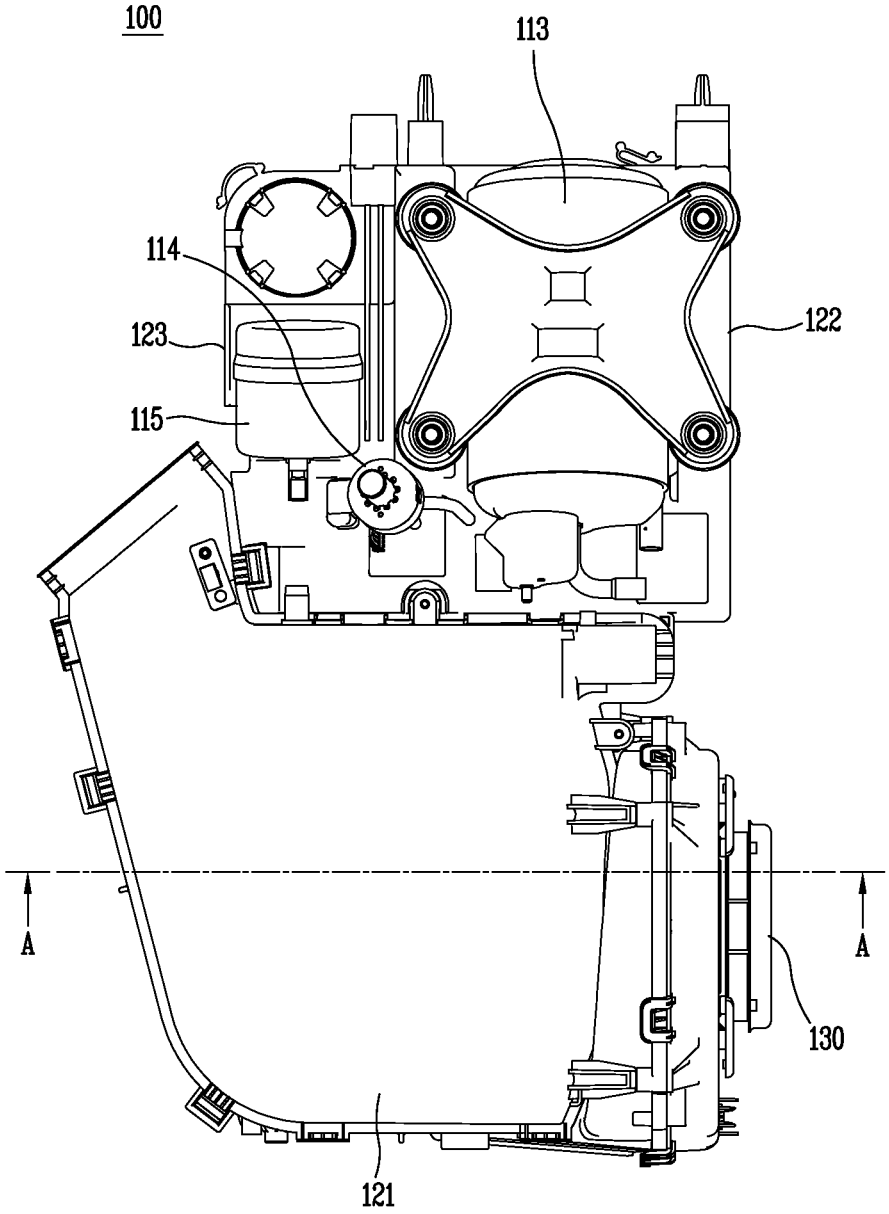
FIG. 3A is a plan view of a heat pump module of FIG. 1B.
Figure 3B:
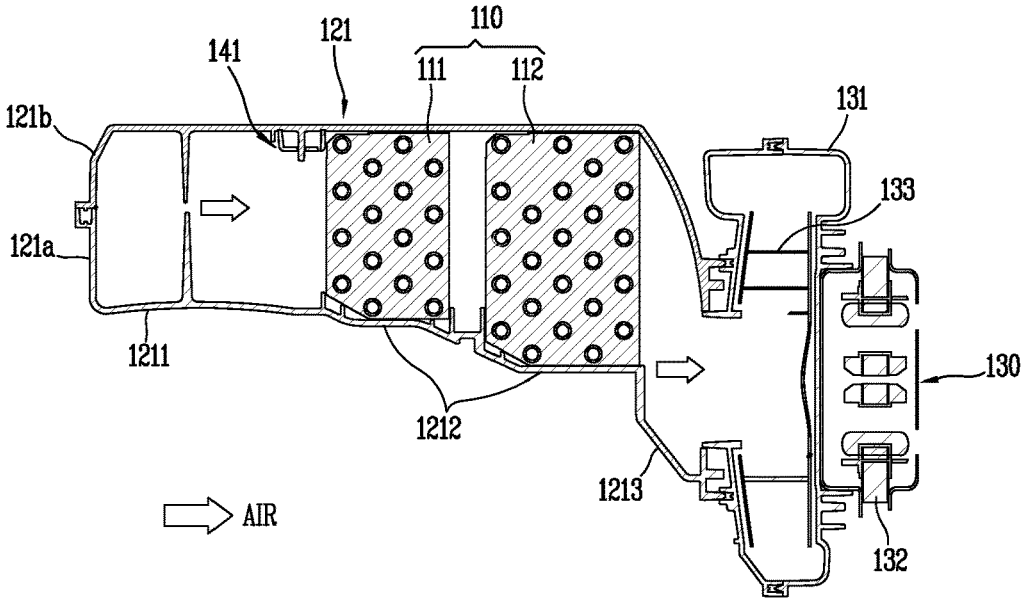
FIG. 3B is a cross-sectional view taken along line A-A of FIG. 3A.

FIG. 3A is a plan view of a heat pump module of FIG. 1B, and FIG. 3B is a cross-sectional view taken along line A-A of FIG. 3A. Referring to FIG. 3A, a lower side in the figure is adjacent to a front side of the tub 17 and the front cover 10*d*, and an upper side is adjacent to a rear side of the tub 17 and the back cover 10*e*. The heat exchange duct unit 121 at the lower side is disposed toward the front side, and the compressor base part 122 at the upper side may be disposed toward a rear side of the tub 17. The expansion valve 114 and the vapor-liquid separator 115 may be disposed between the heat exchange duct unit 121 and the compression base part 122. The vapor-liquid separator 115 is installed in a refrigerant pipe connecting the evaporator 111 and the compressor 113, separates a refrigerant discharged from the evaporator 111 into a gaseous refrigerant and a liquid refrigerant, and subsequently transmits only the gaseous refrigerant to the compressor 113. The vapor-liquid separator 115 may be installed in a vapor-liquid separator installation part 123 integrally formed with a left surface of the compressor base part 122.

Referring to FIG. 3B, in which the heat exchange duct unit 121 is viewed from the front cover 10*d*, the evaporator 111 and the condenser 112 are installed to be spaced apart from each other within the heat exchange duct unit 121. In order to maximize utilization of an upper space of the tub 17, a left side of the heat exchange duct unit 121 may be adjacent the center of an upper portion of the tub 17 and a right side thereof may extend from the center of the upper portion of the tub 17 toward the right side cover 10*b*. Also, a lower surface of the heat exchange duct unit 121 may be rounded along an outer circumferential surface of an upper portion of the tub 17.

Here, since a height space between an outer circumferential surface of the right side of the tub 17 and the top cover 10*a* is greater than a height space between the center of the upper portion of the tub 117 and the top cover 10*a* toward the right side along the outer circumferential surface of the tub 17, the evaporator 111 and the condenser 112 may be disposed to be spaced apart from each other from the center of the upper portion of the tub 17 to the right side and the condenser 112 may further extend in a downward direction to have an increased height, compared with the evaporator 111. Thus, heat-exchange efficiency is increased by utilizing the upper space of the tub 17 to the maximum, enhancing drying performance.

A fan duct unit 131 may be provided on a right side of the heat exchange duct unit 121. A fan motor 132 and an impeller 133 are accommodated and supported within the fan duct unit 131. The fan motor 132 may be installed on the right side of the fan duct unit 131, and the impeller 133 may be rotatably installed on the left side of the fan motor 132. The impeller 133 is connected to a rotational shaft of the fan motor 132, and rotated upon receiving power from the fan motor 132 to pull in internal air in the heat exchange duct unit 121 and transfer the air to the tub 17 and the inside of the drum 18.

The heat exchange duct unit 121 may include a duct body 121*a* and a duct cover 121*b*. The duct body 121*a* accommodates and supports the evaporator 111 and the condenser 112 therein, and the duct cover 121*b* covers an upper portion of the duct body 121*a* to form the air passage together with the duct body 121*a*. That is, the duct cover 121*b* hermetically closes internal air with respect to external air such that internal air of the heat exchange duct unit 121 is not mixed or heat-exchanged with external air, and such that the circulating air is heat-exchanged with only the refrigerant of the heat exchanger 110.

The heat pump module 100 includes a foreign object cleaning unit 140. The foreign object cleaning unit 140 may include a nozzle unit 141 that injects washing water. The nozzle unit 141 may be installed in an upper portion of an air inflow side of the evaporator 111. The nozzle unit 141 may be provided on an inner upper surface of the duct cover 121*b*. The nozzle unit 141 injects water to a front end surface (air inflow side) of the evaporator 111 to remove foreign objects such as lint, or the like, accumulated in the evaporator 111.

Figure 4:
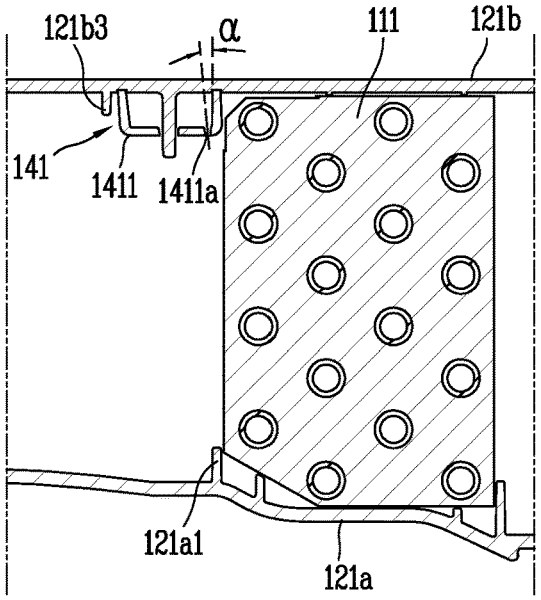
FIG. 4 is an enlarged cross-sectional view illustrating a nozzle unit of FIG. 3B.

FIG. 4 is an enlarged cross-sectional view illustrating the nozzle unit 141 of FIG. 3B. The nozzle unit 141 may include a box-shaped nozzle body 1411 in which an upper side is open and front and rear sides and a lower side thereof are hermetically closed. Here, the front and rear sides may be referred to as a sidewall of a body of the nozzle unit 141. The upper surface of the nozzle body 1411 is opened to maximize size and reduce flow resistance when air is introduced to the evaporator 111. If the upper surface of the nozzle body 1411 is formed to be closed, while the height of the nozzle body 1411 is maintained to be the same, an internal space of the nozzle body 1411 may be reduced by a thickness of the upper surface, and when the upper surface of the nozzle body 1411 is added, while a volume of the internal space of the nozzle body 1411 is maintained to be the same, a height of an air flow channel is reduced by a thickness of the upper surface and flow resistance of air is increased.

The nozzle body 1411 is installed to be adjacent to an upper end of an upstream side of the evaporator 111 in order to prevent generation of an eddy on a rear side of the nozzle body 1411 (a lower side of a downstream with respect to an air movement direction) when air flows. Thus, the nozzle body 1411 contacts the evaporator 111 without a gap therebetween, avoiding flow resistance due to an eddy.

The injection hole 1411*a* injecting washing water may be formed on a lower surface of the nozzle body 1411. A central line (e.g., central axis) of the injection hole 1411*a* is inclined at a preset angle with respect to a vertical plane as an air inflow surface of the evaporator 111. Here, an injection angle α may be varied according to an angle between the central line of the injection hole 1411*a* and the vertical plane of the evaporator 111.

The injection angle α of the injection hole 1411*a* is an important factor of efficiency of removing a foreign object such as lint, or the like, accumulated on the air inflow surface of the evaporator 111. Preferably, the injection angle α of the injection hole 1411*a* is 2 degrees to 10 degrees with respect to a vertical upper surface of the evaporator 111 in an upstream side direction (counterclockwise direction). An optimal angle of the injection angle α between the central line of the injection hole 1411*a* and the vertical plane of the evaporator 111 is 3 degrees.

If the injection angle α is not within the range, efficiency in removing foreign objects may be degraded. For example, as the injection angle α of washing water is greater, that is, as an injection direction of washing water is close to an air movement direction, a force of washing water to separate a foreign object from the air inflow surface of the evaporator 111 in the air movement direction may be increased but foreign objects may merely be pushed into an inner side of the evaporator 111 from the air inflow surface (vertical plane) of the evaporator 111 together with washing water and washing water may not be easily drained to a lower surface of the heat exchange duct unit 121 by gravitation. Also, as the injection angle α of washing water is smaller, that is, as the injection direction of washing water is close to a vertical line, a force of dropping a foreign object from the air inflow surface of the evaporator 111 is added to the gravitational force, and thus, washing water and the foreign object may be moved down along the air inflow surface of the evaporator 111 and discharged to the drain hose 19 through a condensate drainage.

A support protrusion 121*a*1 may protrude from a lower surface of the duct body 121*a* to support a lower portion of the evaporator 111, and prevent introduction of air through a gap between a lower surface of the evaporator 111 and a lower surface of the duct body 121*a*. Thus, since air flows through the inside of the heat exchange duct unit 121 passes through the evaporator 111 without bypassing the evaporator 111, heat-exchange and dehumidification efficiency of the evaporator 111 may be enhanced.

FIG. 5A is a bottom perspective view of a duct cover of FIG. 3B, and FIG. 5B is a bottom view of a duct cover of FIG. 3B. The injection holes 1411*a* may be disposed to be spaced apart from each other in a direction perpendicular to an air movement direction on a lower surface of the nozzle body 1411. Also, the injection holes 1411*a* may be disposed off-center, at a rear end portion (e.g., downflow side) at a lower surface of the nozzle body 1411 so as to be adjacent to an upper end portion of the air inflow surface of the evaporator 111. Thus, washing water may be evenly injected to the air inflow surface of the evaporator 111 through the plurality of injection holes 1411*a*. In our embodiments, a single injection hole 1411*a* having a linear shape, rather than a plurality of ones, may be continuously formed.

A washing water supply pipe 142 communicating with the nozzle unit 141 is provided on a rear side of the duct cover 121*b*. The washing water supply pipe 142 may be connected to the washing water supply unit 145 by a water supply pipe in a direct water manner. The direct type washing water supply unit 145 is connected to a tap of a water supply pipe generally supplied in houses through a water supply hose and directly supplies water through the water hose, without storing water in a predetermined storage space. Since the washing water supply valve 143 is installed in the water supply pipe, a washing water flow channel may be selectively opened and closed.

The washing water supply valve 143 may be configured as an electronic solenoid valve and opened and closed upon receiving a control signal from a controller 144. The controller 144 may control a supply time and a supply amount of washing water as necessary according to an input signal input to a control panel of the cabinet 10 a program previously input according to an operation mode.

The duct cover illustrated in FIG. 5B may include a protrusion portion 121*b*3 to prevent introduction of air between both end portions of the nozzle unit 141 and a side surface of the duct cover 121*b*. The protrusion portion 121*b*3 protrudes inwardly from both sides of the duct cover 121*b* to prevent air flow through air a gap between both end portions of the nozzle unit 141 and the duct cover 12*b*. If air intended to flow through the heat exchange duct unit 121 is introduced to a gap between the both end portions of the nozzle unit 141 and the duct cover, it may bypass, without passing through the evaporator 111, to resultantly degrade heat exchange and dehumidification efficiency of the evaporator 111. A length of the protrusion portion 121*b*3 protruding downward from an inner side of the duct cover 121*b* may be smaller than a height of the nozzle unit 141. Thus, air may easily move over the nozzle unit 141 along the protrusion portion 121*b*3, minimizing flow resistance of air.

Figure 6A:
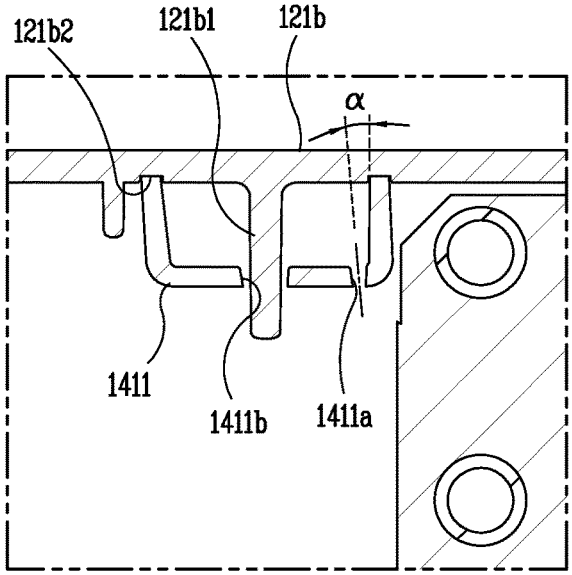
FIG. 6A is an enlarged cross-sectional view illustrating a configuration before a coupling protrusion of FIG. 4 is fused.
Figure 6B:
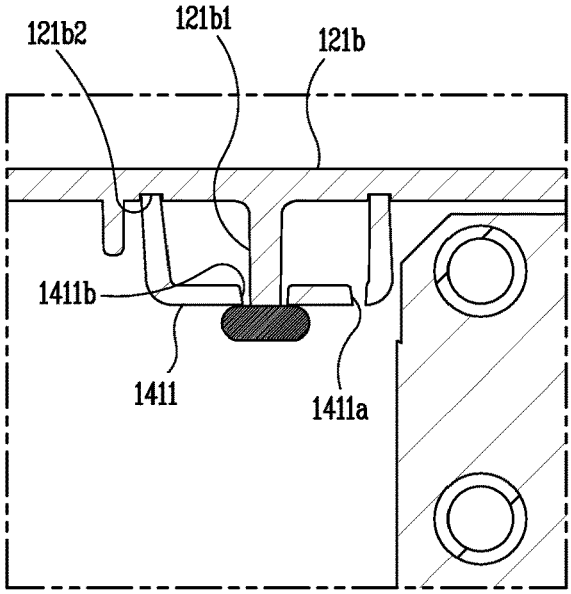
FIG. 6B is an enlarged cross-sectional view illustrating a configuration after a coupling protrusion of FIG. 4 is fused.

FIG. 6A is an enlarged cross-sectional view illustrating a configuration before a coupling protrusion of FIG. 4 is fused, and FIG. 6B is an enlarged cross-sectional view illustrating a configuration after a coupling protrusion of FIG. 4 is fused.

The nozzle unit 141 may be integrally coupled to the duct cover 121*b* of the heat exchange duct unit 121. An upper surface of the nozzle body 1411 may be hermetically closed by the duct cover 121*b*. In order to maintain airtightness of the nozzle body 1411 and the duct body 121*a*, an airtight recess 121*b*2 may be formed for creating an airflow seal with the nozzle body 1411 and an upper end portion of the nozzle body 1411 may be inserted into the airtight recess 121*b*2 so as to be compressed.

A plurality of coupling protrusions 121*b*1 may be disposed to be spaced apart from each other in a direction perpendicular to an air movement direction on an inner upper surface of the duct body 121*a* and directly protrude from the duct body 121*a*. A through hole 1411*b* is formed on a lower surface of the nozzle body 1411 to allow the coupling protrusion to be inserted therein in a penetrating manner. The through holes 1411*b* are disposed to be spaced apart from each other in a longitudinal direction of the nozzle body 1411.

Referring to FIG. 6B, a lower end portion of the coupling protrusion 141*b*1 inserted to penetrate through the lower surface of the nozzle body 1411 may be compressed by a hot pressure welding press having a heater, or the like, so as to be fused (welded). Since the fused lower end portion of the coupling protrusion 121*b*1 is fused by heat, a gap between the through hole 1411*b* of the nozzle body 1411 and the coupling protrusion 121*b*1 is blocked to prevent the nozzle body 1411 from being separated from the duct cover 121*b* and to form a water-tight seal.

Figure 7:
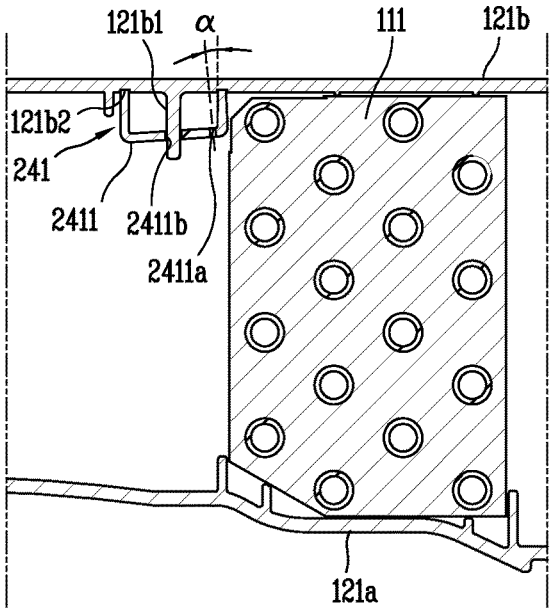
FIG. 7 is a cross-sectional view illustrating another embodiment of a nozzle unit according to the present disclosure.

FIG. 7 is a cross-sectional view illustrating another embodiment of a nozzle unit according to the present disclosure. Unlike the embodiment of FIG. 4, the nozzle unit 241 may be installed to be inclined with respect to the vertical plane of the evaporator 111, or a front surface and a rear surface of the nozzle unit 241 may be formed to be vertical and a lower surface of the nozzle unit 241 may be inclined at a preset angle α with respect to a horizontal plane toward the evaporator 111.

For example, a central line of the injection hole 2411*a* may be at a right angle or perpendicular to the lower surface of the nozzle body 2411. An inner circumferential surface of the injection hole 2411*a* may be symmetrical to each other with respect to the central line, and may be tapered to have a conic shape. In a case in which the lower surface of the nozzle body 2411 is sloped to the horizontal plane, the nozzle body 2411 may be reduced in height toward the rear side (downstream side) from the front side (upstream side). The injection holes 2411*a* may be formed to be adjacent to the air inflow surface (vertical plane) of the evaporator 111 and formed to be perpendicular to the lower surface of the nozzle body 2411.

Here, an injection angle α between the central line of the injection hole 2411*a* and the vertical plane of the evaporator 111 is preferably within a range from 2 to 10 degrees. Also, 3 degrees of the injection angle α is an optimal angle. If the injection angle α is excessively greater than the range, washing water and a foreign object may be more widely spread to an inner side of the evaporator 111 due to cohesiveness between washing water including a foreign object and the heat transmission plate 110*b* of the evaporator 111, degrading a foreign object removing efficiency, and if the injection angle α is excessively smaller than the range, washing water may not reach the evaporator 111 but directly drained downwardly on a front side of the evaporator 111 due to a formation error of the injection hole 2411*a*.

Figure 8:
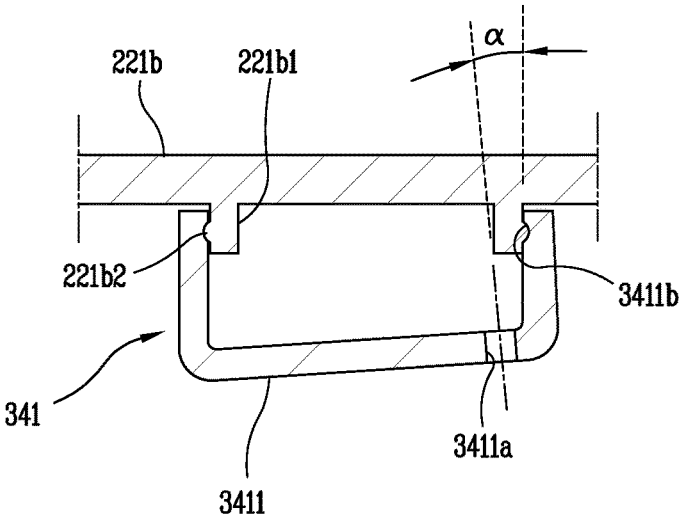
FIG. 8 is a cross-sectional view illustrating another coupling structure of a nozzle unit according to the present disclosure.

FIG. 8 is a cross-sectional view illustrating another coupling structure of a nozzle unit according to the present disclosure. Sliding guides 221*b*1 may be provided to face each other and protrude from an inner upper surface of the duct cover 221*b*. Sliding guides 221*b*1 may be spaced apart from each other in an air movement direction, and may extend in a direction perpendicular to the air movement direction. A protrusion 221*b* may be formed in a longitudinal direction on a front surface (upstream side) or on a rear surface (downstream side) of the sliding guide 221*b*1.

A guide recess 3411*b* may be formed on both inner side surfaces of upper end portions of the nozzle body 3411, and the nozzle body 3411 may be inserted along the sliding guide 221*b*1 so as to be slidably coupled. Here, as the protrusion 221*b*2 of the sliding guide 221*b*1 is inserted into the guide recess 3411*b* of the nozzle body 3411, the nozzle body 1411 is coupled to the duct cover 121*b*.

Here, the guide recess 3411*b* may be formed in the sliding guide 221*b*1, and the protrusion 221*b*2 may be formed in the nozzle body 3411 The opposite configuration is also possible. Also, the coupling structure of the sliding guide 221*b*1 employed in the nozzle body 3411 of FIG. 8 may also be applied to the nozzle unit 141 of FIG. 4. Moreover, central line of the injection hole 3411*a* may be formed to be at a right angle or perpendicular with respect to the lower surface of the nozzle body 3411 in the same manner as that of FIG. 7.

As disclosed more on an aspect of the detailed description is to provide a clothes treating apparatus capable of automatically removing a foreign object such as lint, or the like, accumulated in a heat exchanger, without having to open a cover of a cabinet or without providing a manual operational force or external force to the outside of the cabinet.

To achieve these and other advantages and in accordance with the purpose of this specification, as embodied and broadly described herein, a clothes treating apparatus may include: a cabinet; a drum provided within the cabinet and providing an accommodation space of laundry or a dry target; a heat pump module having a compressor, a condenser, an expansion valve, and an evaporator circulating a refrigerant, allowing air discharged from the drum to pass through the evaporator and the condenser and re-circulating air to the drum; and a foreign object cleaning unit injecting washing water to the evaporator to clean a foreign object stuck to the evaporator.

The foreign object cleaning unit may include: a washing water supply unit; and a nozzle unit injecting washing water supplied from the washing water supply unit to a vertical plane as a washing water injection surface of the evaporator, to slope at a preset angle.

The washing water supply unit may include: a washing water supply pipe supplying washing water in a direct water manner and connecting the washing water supply unit and the nozzle unit; and a washing water supply valve installed in the washing water supply pipe and opening and closing a flow channel. Moreover, the foreign object cleaning unit may include a controller controlling the washing water supply valve to selectively supply washing water to the nozzle unit.

A clothes treating apparatus related to the present invention may include: a cabinet; a drum provided within the cabinet and providing an accommodation space of laundry or a dry target; an evaporator heat-exchanging a refrigerant with air discharged from the drum to dehumidify air; and a foreign object cleaning unit injecting water to the evaporator to clean a foreign object stuck to the evaporator, wherein the foreign object cleaning unit has an injection hole and injects washing water supplied from a washing water supply unit to an injection surface of the evaporator to slope at a preset angle.

The clothes treating apparatus may further include: a duct body accommodating the evaporator; and a duct cover covering an upper portion of the duct body, wherein the nozzle unit has a plurality of coupling holes provided on a lower surface thereof, a plurality of coupling protrusions protrude from an inner surface of the duct cover in a downward direction and inserted into the plurality of coupling holes, respectively, and the nozzle unit is integrally coupled to an inner side of the duct cover by welding lower end portions of the plurality of coupling protrusions penetrating through the plurality of coupling holes.

The nozzle unit may be an upper open type nozzle unit having a box shape in which an upper side is open. The nozzle unit may be disposed to be in contact with an upper end portion of an injection surface of the evaporator. The nozzle unit may extend in a forward/backward direction of the cabinet from an inner surface of the duct cover.

The injection hole may be formed such that a central line thereof is inclined at a preset angle with respect to the injection surface of the evaporator. The nozzle unit itself may be formed to be inclined at a preset angle toward the injection surface of the evaporator, so that a central line thereof is inclined at the preset angle with respect to the injection surface of the evaporator.

The nozzle unit may be formed such that a lower surface thereof is inclined at a preset angle toward the injection surface of the evaporator, so that a central line thereof is inclined at the preset angle with respect to the injection surface of the evaporator.

The duct cover may further include: a protrusion, and the protrusion may protrude in a direction across an inner surface and both side surfaces of the duct cover to block a gap between both end portions of an entrance side of the nozzle unit and the duct cover. Moreover, an airtight recess formed to be concave may be provided in an inner surface of the duct cover to allow an upper end portion of the nozzle unit to be inserted thereto.

The present disclosure configured as described has the following effects.

First, since water is automatically injected from the nozzle unit to remove a foreign object such as lint, or the like, accumulated in a heat exchanger, flow resistance in the heat resistance may be reduced and dry performance may be enhanced.

Second, if necessary, washing water is automatically injected to an air inflow portion of the heat exchanger to simply clean lint, or the like, accumulated in the heat exchanger. For example, lint of the heat exchanger may be cleaned even without opening a cover of the cabinet, without a manual operation or without providing an external force based on a mechanical force, or the like.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus comprising:

a cabinet;

a drum provided within the cabinet and having an accommodation space for laundry for washing or drying;

an evaporator to allow a refrigerant to undergo heat exchange with air discharged from the drum to dehumidify air;

a heat exchanger duct housing the evaporator, the heat exchange duct forming a flow path to circulate air through the drum and the heat exchanger duct; and a foreign object cleaning unit including a nozzle unit defining a flow path of water therein, the nozzle unit provided with a plurality of nozzles at a bottom surface of the nozzle unit to inject the water to a surface of the evaporator to clean foreign objects stuck to the evaporator, wherein a top surface of the nozzle unit is open and mounted on an inner surface of an upper portion of the heat exchanger duct to be covered by the heat exchanger duct.

2. The clothes treating apparatus of claim 1, wherein the heat exchanger duct is provided over the drum, wherein the evaporator is provided in the heat exchanger duct such that the surface of the evaporator to be cleaned faces the flow path.

3. The clothes treating apparatus of claim 2, wherein the foreign object cleaning unit includes a washing water supply valve connected to the washing waster supply unit; and a washing water supply pipe connected to the washing water supply valve, wherein the nozzle unit provided in the heat exchanger duct and coupled to the washing water supply pipe.

4. The clothes treating apparatus of claim 3, wherein the plurality of nozzles are formed on a surface of a body of the nozzle unit.

5. The clothes treating apparatus of claim 4, wherein the body of the nozzle unit has a prescribed shape that extends laterally along the surface of the evaporator, wherein the body has a bottom surface, a first sidewall that extends upwards from the bottom surface adjacent the surface of the evaporator, and a second sidewall that extends upwards from the bottom surface opposite the first sidewall.

6. The clothes treating apparatus of claim 5, wherein the plurality of nozzles are provided on the bottom surface or the first sidewall of the body near the surface of the evaporator to be cleaned, the plurality of nozzles being positioned at a prescribed angle relative to the surface of the evaporator.

7. The clothes treating apparatus of claim 5, wherein a recess is formed on an inner surface of the heat exchanger duct to couple with an upper end of the first side wall or the second side wall of the nozzle unit to form a watertight seal between the upper end of the nozzle unit and the duct cover.

8. The clothes treating apparatus of claim 4, wherein the plurality of nozzles are formed such that a central axis of the nozzle is inclined at a prescribed angle with respect to the surface of the evaporator.

9. The clothes treating apparatus of claim 8, wherein the body of the nozzle unit is formed to be inclined at a prescribed angle toward the surface of the evaporator such that the central axis of the plurality of nozzles is inclined at the prescribed angle with respect to the surface of the evaporator.

10. The clothes treating apparatus of claim 8, wherein the bottom surface of the nozzle unit is inclined at the prescribed angle toward the injection surface of the evaporator such that the central axis is inclined at the prescribed angle with respect to the surface of the evaporator.

11. The clothes treating apparatus of claim 2, wherein the heat exchanger duct includes a duct body that accommodates the evaporator, and a duct cover that covers an upper portion of the duct body, wherein the duct body and the duct cover form the flow path to circulate air from the drum.

12. The clothes treating apparatus of claim 11, wherein the nozzle unit is fixed to an upper surface of the duct cover, the nozzle unit having a plurality of coupling holes provided on a bottom surface thereof, and the duct cover having a plurality of coupling protrusions that protrudes downward from an inner surface of the duct cover and inserted into the plurality of coupling holes, wherein lower end portions of the plurality of coupling protrusions that penetrates through the plurality of coupling holes are coupled to fix the nozzle unit to the inner surface of the duct cover.

13. The clothes treating apparatus of claim 11, wherein the nozzle unit has a box shape.

14. The clothes treating apparatus of claim 11, wherein a sidewall of the nozzle unit is disposed to be in contact with an upper end portion of the surface of the evaporator.

15. The clothes treating apparatus of claim 11, wherein the duct cover includes protrusions that protrude from lateral ends of the duct cover to block gaps between both end portions of the nozzle unit and the duct cover.

16. A clothes treating apparatus comprising:

a cabinet;

a drum provided within the cabinet and having an accommodation space for laundry for washing or drying;

a heat exchanger duct provided over the drum and forming a flow path for circulating air between the drum and the heat exchanger duct;

an evaporator provided in the heat exchanger duct, the evaporator to allow a refrigerant to undergo heat exchange with air discharged from the drum to dehumidify air; and a nozzle unit provided in the heat exchanger duct adjacent to an inlet surface of the evaporator, the nozzle unit to inject water on the inlet surface of the evaporator to clean foreign objects stuck to the evaporator, wherein the nozzle unit includes a plurality of nozzles formed on a surface of the nozzle unit adjacent to the inlet surface evaporator, the plurality of nozzles being positioned to be obliquely angled relative to the inlet surface of the evaporator, wherein a top surface of the nozzle unit is open and mounted on an inner surface of an upper portion of the heat exchanger duct to be covered by the heat exchanger duct.

17. The clothes treating apparatus of claim 16, wherein the nozzle unit is provided in the heat exchanger duct to extend parallel to the inlet surface of the evaporator.

18. The clothes treating apparatus of claim 17, wherein a distal end of the nozzle unit is coupled to a washing water supply pipe installed through the heat exchanger duct.

19. The clothes treating apparatus of claim 16, wherein a body of the nozzle unit has a prescribed shape that extends parallel adjacent to the inlet surface of the evaporator, wherein the body has a bottom surface, a first sidewall that extends upwards from the bottom surface adjacent the surface of the evaporator, and a second sidewall that extends upwards from the bottom surface opposite the first sidewall.

20. The clothes treating apparatus of claim 19, wherein the plurality of nozzles are provided on the bottom surface or the first sidewall of the body near the inlet surface of the evaporator, the plurality of nozzles being positioned at a prescribed angle relative to the inlet surface of the evaporator.

21. The clothes treating apparatus of claim 12, wherein the lower end portions of the plurality of coupling protrusions are welded to the bottom surface of the nozzle unit.

* * * * *